US005692250A

United States Patent [19]

Oldfelt et al.

[11] Patent Number: 5,692,250

[45] Date of Patent: Dec. 2, 1997

[54] VACUUM TOILET SYSTEM WITH TREATED RINSE LIQUID

[75] Inventors: Sven Oldfelt, Vaxholm, Sweden; Gary L. Stahl, Winnebago; Paul L. Dubler, Rockford, both of Ill.; Lars Erik A. E. Glas, Täby; Anders G. Östman, Järfälla, both of Sweden

[73] Assignee: Oy Wartsila Ab, Helsinki, Finland

[21] Appl. No.: 288,441

[22] Filed: Aug. 9, 1994

Related U.S. Application Data

[63] Continuation of Ser. No. 24,829, Mar. 1, 1993, abandoned, which is a continuation of Ser. No. 894,159, Jun. 1, 1992, abandoned, which is a continuation of Ser. No. 598,997, Oct. 17, 1990, abandoned, which is a continuation-in-part of Ser. No. 394,072, Aug. 15, 1989, Pat. No. 5,245,711.

[51] Int. Cl.[6] ..... E03D 11/00

[52] U.S. Cl. ..... 4/432; 4/224

[58] Field of Search ..... 4/222, 222.1, 223, 4/224, 225.1, 226.1, 320, 321, 431–433

[56] References Cited

U.S. PATENT DOCUMENTS

| | | | |
|---|---|---|---|
| 3,154,796 | 11/1964 | Bruce . | |
| 3,329,974 | 7/1967 | Belasco et al. . | |
| 3,699,592 | 10/1972 | Minchak | 4/320 |
| 3,844,946 | 10/1974 | Farrell | 4/320 X |
| 3,927,425 | 12/1975 | Delaney et al. . | |
| 3,995,327 | 12/1976 | Hendrick . | |
| 4,063,315 | 12/1977 | Carolan et al. . | |
| 4,156,297 | 5/1979 | Pilolla | 4/320 |
| 4,262,372 | 4/1981 | Ryder | 4/224 X |
| 4,363,795 | 12/1982 | Wahlstam | 424/49 X |
| 4,376,314 | 3/1983 | Iwans . | |
| 4,521,925 | 6/1985 | Chen et al. . | |
| 4,522,738 | 6/1985 | Magid et al. | 15/208 X |
| 4,713,847 | 12/1987 | Oldfelt et al. . | |
| 4,841,578 | 6/1989 | Mercer | 4/224 |
| 4,963,491 | 10/1990 | Hellgren et al. | 435/212 X |

FOREIGN PATENT DOCUMENTS

| | | | |
|---|---|---|---|
| 108419 | 12/1967 | Denmark . | |
| 2286922 | 4/1976 | France . | |
| 3110558 | 4/1983 | Germany . | |
| 3500130 | 7/1986 | Germany . | |
| 3536691 | 4/1987 | Germany . | |
| 3615655 | 11/1987 | Germany | 4/226.1 |
| 355040 | 7/1973 | Sweden . | |

*Primary Examiner*—Charles E. Phillips
*Attorney, Agent, or Firm*—Smith-Hill and Bedell

[57] ABSTRACT

A vacuum toilet system comprises a toilet bowl having an outlet opening, a sewer pipe having an interior space, a discharge valve connecting the outlet opening of the toilet bowl to the sewer pipe, and a source of partial vacuum for establishing a lower pressure in the interior space of the sewer pipe than in the toilet bowl. A nozzle defines a rinse liquid outlet for introducing liquid into the toilet bowl. A container for reagent is in communication with the rinse liquid outlet. Reagent is introduced into the toilet bowl by way of the rinse liquid outlet in timed relationship to introduction of rinse liquid into the toilet bowl.

23 Claims, 2 Drawing Sheets

VACUUM TOILET SYSTEM WITH TREATED RINSE LIQUID

CROSS-REFERENCE TO RELATED APPLICATIONS

This application is filed as a continuation of application No. 08/024,829 filed Mar. 1, 1993, and now abandoned, which was filed as a continuation of application No. 07/894,159 filed Jun. 1, 1992 and now abandoned, which was filed as a continuation of application No. 07/598,997 filed Oct. 17, 1990 and now abandoned, which was filed as a continuation-in-part of application No. 07/394,072 filed Aug. 15, 1989, now U.S. Pat. No. 5,245,711.

BACKGROUND OF THE INVENTION

This invention relates to a vacuum toilet system with treated rinse liquid.

Non-recirculating vacuum toilet systems using plain water as a rinse liquid are attractive for use in aircraft. In such a system, it is conventional for the rinse liquid to be provided from the aircraft's potable water system. The potable water system includes a tank, pipes connecting the tank to consuming devices, such as the vacuum toilets and hand basins, and a pump for maintaining the water in the pipes under pressure.

A known vacuum toilet system that is suitable for use on aircraft comprises a waste-receiving bowl, a sewer pipe that can be placed under a pressure that is substantially lower than that in the interior of the waste-receiving bowl, and a discharge valve for controlling passage of material from the waste-receiving bowl into the sewer pipe. A spray ring extends around the rim of the waste-receiving bowl and is formed with nozzles, which are positioned so that the entire internal surface of the bowl is rinsed when the spray ring is connected to the aircraft's potable water system.

The supply of water to the spray ring is controlled by a rinse water control valve, which operates in response to an electrical signal that is generated by a flush control unit when it receives a flush initiation signal. A vacuum breaker is connected between the rinse water control valve and the spray ring.

A disadvantage of this known type of vacuum toilet system arises because a small amount of water remains in the rinse water supply pipe downstream of the vacuum breaker when the rinse water control valve closes, and this water drips out through the nozzles of the spray ring between flushes. Some of this water evaporates, and calcium carbonate dissolved in the water is deposited in the toilet bowl and in the nozzles themselves. Consequently, the surface of the toilet bowl becomes roughened and the nozzles become clogged. The roughening of the surface of the toilet bowl impairs the efficiency with which waste is removed during the flushing operation, and even partial clogging of the nozzles affects the spray pattern provided by the nozzles and impairs the rinse function.

The problem of calcium carbonate build-up is at least partially avoided in the vacuum toilet system disclosed in U.S. Pat. No. 5,245,711, issued Sep. 21, 1993, the disclosure of which is hereby incorporated by reference herein, since in that toilet system no water remains in the rinse water supply pipe after a flush is completed.

In an aircraft vacuum toilet system, very little rinse liquid is used on each flush, and a very large volume of air passes through the system on each flush. These two factors in combination result in a build-up of a hard residue or plaque on the internal surfaces of the sewer pipe and the holding tank. It is possible to remove the residue by periodically cleaning the pipe with acid, but safety factors militate against use of acids aboard aircraft. Further, deposit of waste on level sensors in the tank may impair the accuracy of the level sensors.

It is known to introduce a chemical reagent into the rinse water of a conventional flush toilet for sanitizing the toilet bowl at each flush. This may be done by hanging a cake of water-soluble material in the toilet tank. However, to the best of the applicants' knowledge a similar technique has never been applied to vacuum toilet systems, particularly for aircraft use. This might be because according to current practices an electric pump would be required in order to introduce the chemical reagent into the rinse liquid of a vacuum toilet system, and this would necessitate an additional electrical outlet. The need for an additional electrical outlet is a particular disadvantage with respect to retrofitting an existing aircraft vacuum toilet system with a reagent-introduction pump. Further, the electric pump needs to be controlled, and this implies that the flush control unit has to be modified, and that control lines are required between the flush control unit and the pump.

An aircraft toilet system comprises a holding tank for receiving waste. In accordance with current practice, a pre-charge of bactericide is placed in the holding tank in order to treat sewage that is collected in the holding tank. A large aircraft, such as a Boeing 747–400, might have four independent toilet systems, each with a holding tank, and the total mass of the pre-charge might be more than 75 kg.

It has been found that a build-up of plaque occurs on the rotating disk of the valve shown in U.S. Pat. No. 4,713,847. This probably occurs because sewage enters the valve housing as the hole in the disk passes the seals and the high concentration of salts in the sewage inside the valve housing forms a deposit on the disk. The plaque increases the drag on the disk and consequently the current needed to drive the valve increases, as does the time needed for the disk to rotate to its end position. If the flush control unit (FCU) that controls operation of the valve senses a combination of current and time, the presence of the plaque may cause the FCU to respond as if the valve were jammed. The problem of improper response of the FCU may be alleviated by adjusting the control algorithm of the FCU, but this measure does not solve the underlying problem of the plaque deposit.

SUMMARY OF THE INVENTION

In accordance with a first aspect of the invention, a vacuum toilet system comprises a toilet bowl having a rim and an outlet opening, a toilet bowl cover mounted for movement relative to the toilet bowl between an open position and a closed position, the cover being in at least partially sealing relation with the rim when in the closed position, a sewer pipe having an interior space, means for establishing a partial vacuum in the interior space of the sewer pipe, a discharge valve connecting the outlet opening of the toilet bowl to the sewer pipe, means defining a rinse liquid outlet for introducing liquid into the toilet bowl when the cover is in the closed position, a source of rinse liquid, a reservoir having an inlet opening for receiving rinse liquid from the source and an outlet opening in communication with the rinse liquid outlet, the inlet opening of the reservoir being exposed to substantially the same pressure as the rinse liquid outlet when the cover is in the open position and the discharge valve is closed, and a container for reagent, said container being in communication with the rinse liquid outlet, whereby rinse liquid and reagent are drawn from the reservoir and container respectively into the toilet bowl by way of the rinse liquid outlet when the discharge valve is open and the cover is in the closed position.

In accordance with a second aspect of the invention, a vacuum toilet system comprises a toilet bowl having an outlet opening, a sewer pipe having an interior space, a discharge valve connecting the outlet opening of the toilet bowl to the sewer pipe, a source of partial vacuum for establishing a lower pressure in the interior space of the sewer pipe than in the toilet bowl, means defining a rinse liquid outlet for introducing liquid into the toilet bowl, power means for supplying rinse liquid to the rinse liquid outlet, a container for reagent, said container being in communication with the rinse liquid outlet, and metering means for introducing reagent from the container into the toilet bowl by way of the rinse liquid outlet, the metering means operating in timed relationship to the power means.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION

Figure 1:
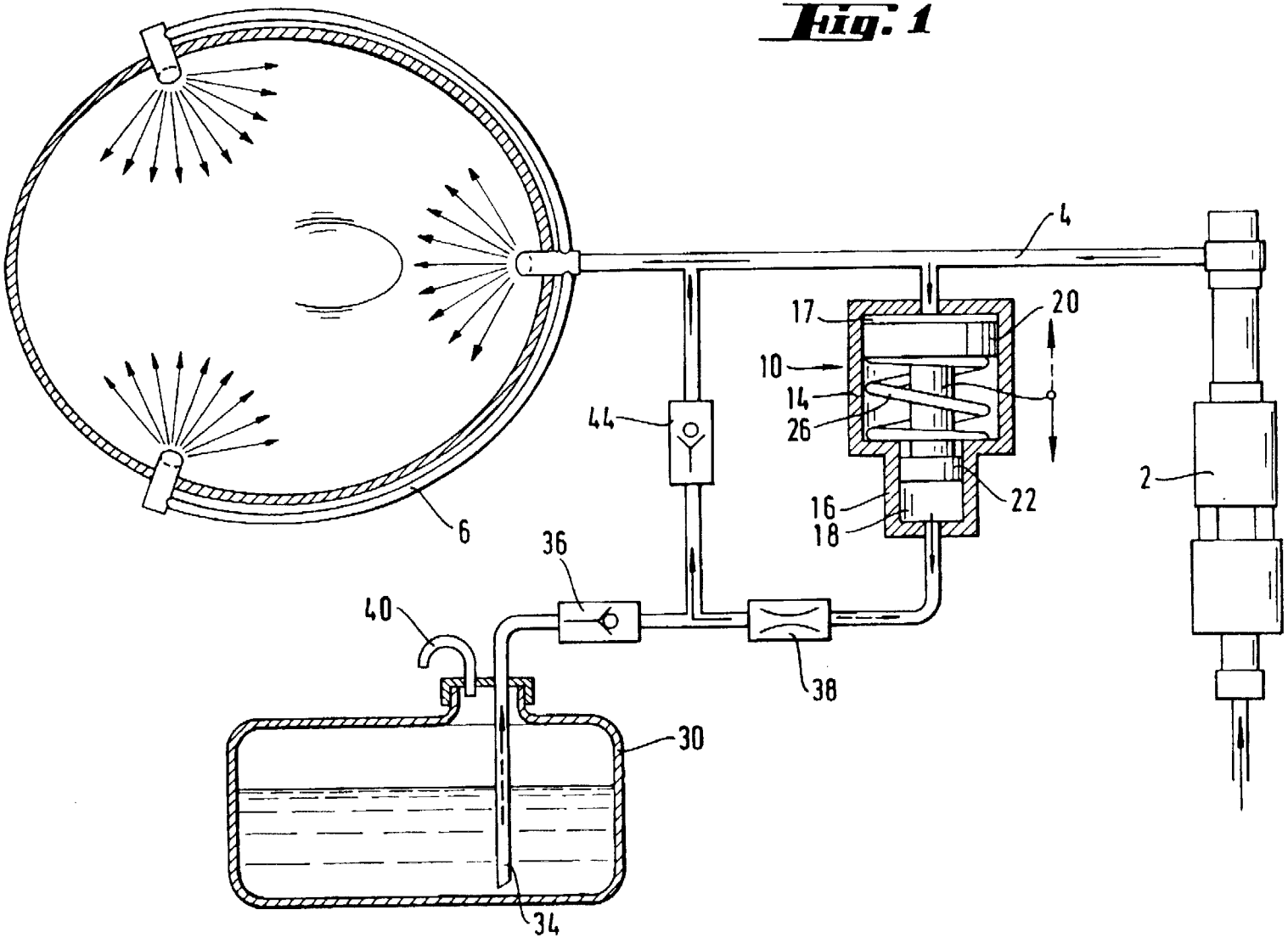
FIG. 1 illustrates schematically a first vacuum toilet system embodying the present invention.

FIG. 1 illustrates schematically how a liquid reagent may be introduced into a flow of pressurized rinse liquid in a vacuum toilet system of the kind shown in U.S. Pat. No. 4,713,847, the disclosure of which is hereby incorporated by reference herein. The illustrated system comprises an integrated vacuum breaker and solenoid valve 2 of the kind described in U.S. Pat. No. 4,811,754, having an inlet connected to a supply of rinse water under pressure and an outlet connected through a rinse water supply pipe 4 to a spray ring 6. This system also includes a pressure-actuated pump 10, which comprises a housing defining large and small diameter cylinders 14,16 and pistons 20,22 fitted in the cylinders respectively, whereby two variable-volume chambers 17,18 of different diameter are formed. The two pistons are connected rigidly together to form a unitary piston member. A compression spring 26 urges the piston member toward the position in which the volume of the large diameter chamber is a minimum.

The large diameter chamber 17 is an actuation chamber and is connected to a branch of the rinse water supply pipe 4. A container 30 for receiving a liquid reagent is provided with a dip tube 34, which is connected through a check valve 36 and an orifice 38 to the small diameter pumping chamber 18 of the pump, and is also provided with a vent tube 40. The point of connection of the check valve 36 and the orifice 38 is connected through a second check valve 44 to the rinse water supply pipe.

The rinse water supply valve 2 is opened in respone to a flush command. When the valve 2 is opened, water under pressure is delivered into the rinse water supply pipe 4, so that the pressure in the rinse water supply pipe increases and consequently the piston member 20/22 is displaced against the force of the compression spring 26 in the direction such that the volume of the pumping chamber 18 is reduced. Fluid present in the pumping chamber is displaced through the orifice 38 and the second check valve 44 into the rinse water supply pipe. When the rinse water valve closes, the compression spring is able once more to displace the piston member 20/22 in the direction such that the volume of the actuation chamber 17 is reduced. The pressure in the pumping chamber falls, and the check valve 44 prevents this pressure difference from being relieved by entry of fluid from the rinse water supply pipe. However, the check valve 36 allows liquid to be drawn from the container 30. Accordingly, liquid reagent is drawn from the container into the pumping chamber. The next time the rinse water valve is opened and the piston member 20/22 is displaced against the force of the compression spring, liquid reagent in the pumping chamber is displaced through the orifice and the check valve into the rinse water supply pipe. Therefore, each time the rinse water valve is opened, a metered dose of liquid reagent is introduced into the rinse water supply pipe. By virtue of the fact that the pump is pressure actuated, it is not necessary to provide an additional electrical outlet or control lines, and this facilitates retrofit of the pump and container to an existing vacuum toilet system.

The pump supplies a predetermined volume of liquid reagent per stroke. The orifice is sized so that the pump stroke takes the same time as the rinse valve cycle, so that the liquid reagent is supplied throughout the rinse valve cycle and is substantially uniformly diluted.

The liquid reagent in the container preferably comprises a mixture of four principal components. These components are a bactericide, a surfactant, an agent to inhibit precipitation of calcium carbonate, and an agent for dissolving existing deposits of calcium carbonate.

The bactericide knolls bacteria present in the waste. Use of the bactericide in the liquid reagent avoids the need for a pre-charge of bactericide in the holding tanks, and ensures that the amount of bactericide that is used is always closely related to the amount needed. The preferred bactericide is a quaternary amine. To be effective, the quarternary amine should be present in the sewage (waste plus rinse water) at a concentration in the range from abut 600 ppm to about 800 ppm.

The preferred surfactant is an amphoteric tenside, preferably an ethoxylated alcohol, which is low foaming, nonionic and biodegradable. The function of the surfactant is to prevent precipitation of solids on the internal surfaces of the sewer pipes and the holding tank by an emulsification action that keeps the solids in suspension. The surfactant also improves the wetting of the internal surfaces of the holding tank and pipes and thereby encourages removal of any plaque deposits that have previously been formed. In addition, the surfactant improves the cleaning of the toilet bowl.

The preferred anti-precipitation agent is sodium phosphonate, which forms complex ions with calcium and thereby increases the threshold concentration for calcium precipitation.

The agent that is employed to dissolve calcium carbonate precipitations that have already been formed is preferably acetic acid.

The preferred components of the liquid reagent are all water-miscible, and the preferred liquid reagent is an aqueous mixture of these components.

A modern aircraft vacuum toilet system employs about 0.2 l of water on each flush, and the volume of waste is typically about 0.25 l on each flush. An effective concentration of the quaternary amine in the sewage (waste plus rinse water) can be achieved by including the quaternary amine in the liquid reagent at a concentration of about fifteen percent by volume and introducing a dose of 1.5 ml of the liquid reagent at each flush. Accordingly, the pump is dimensioned to introduce 1.5 ml of liquid reagent per stroke.

At the concentration of fifteen percent by volume, the quaternary amine is considered non-hazardous. On further dilution by dumping the contents of the holding tank into a municipal sewer, the quaternary amine is non-toxic and is biodegradable and therefore the sewage in the tank can be discharged into a municipal sewer without further treatment.

The amphoteric tenside, sodium phosphonate, and acetic acid are preferably present in the liquid reagent at concentrations of twenty percent by volume, twenty percent by volume, and five percent by volume respectively. The pH of the liquid reagent is about 5.2.

In addition to the four principal components mentioned above, coloring and deodorizing agents may be included in the liquid reagent, typically at a concentration of less than about one percent by volume.

One liter of liquid reagent is sufficient for about seven hundred flushes, and depending on toilet usage, this would last at least fifty flight hours. One liter of liquid reagent has a mass of about 1.02 kg, so that the average mass of reagent, which is assumed to be when the container is half full, is 0.51 kg. The container itself and the pump have a mass of about 1.4 kg. Accordingly, the total mass would be about 1.9 kg per toilet. In the case of a Boeing 747–400 having fourteen toilets, the total mass would be 26.6 kg, providing a saving of almost 50 kg compared with the use of a pre-charge of bactericide.

Figure 2:
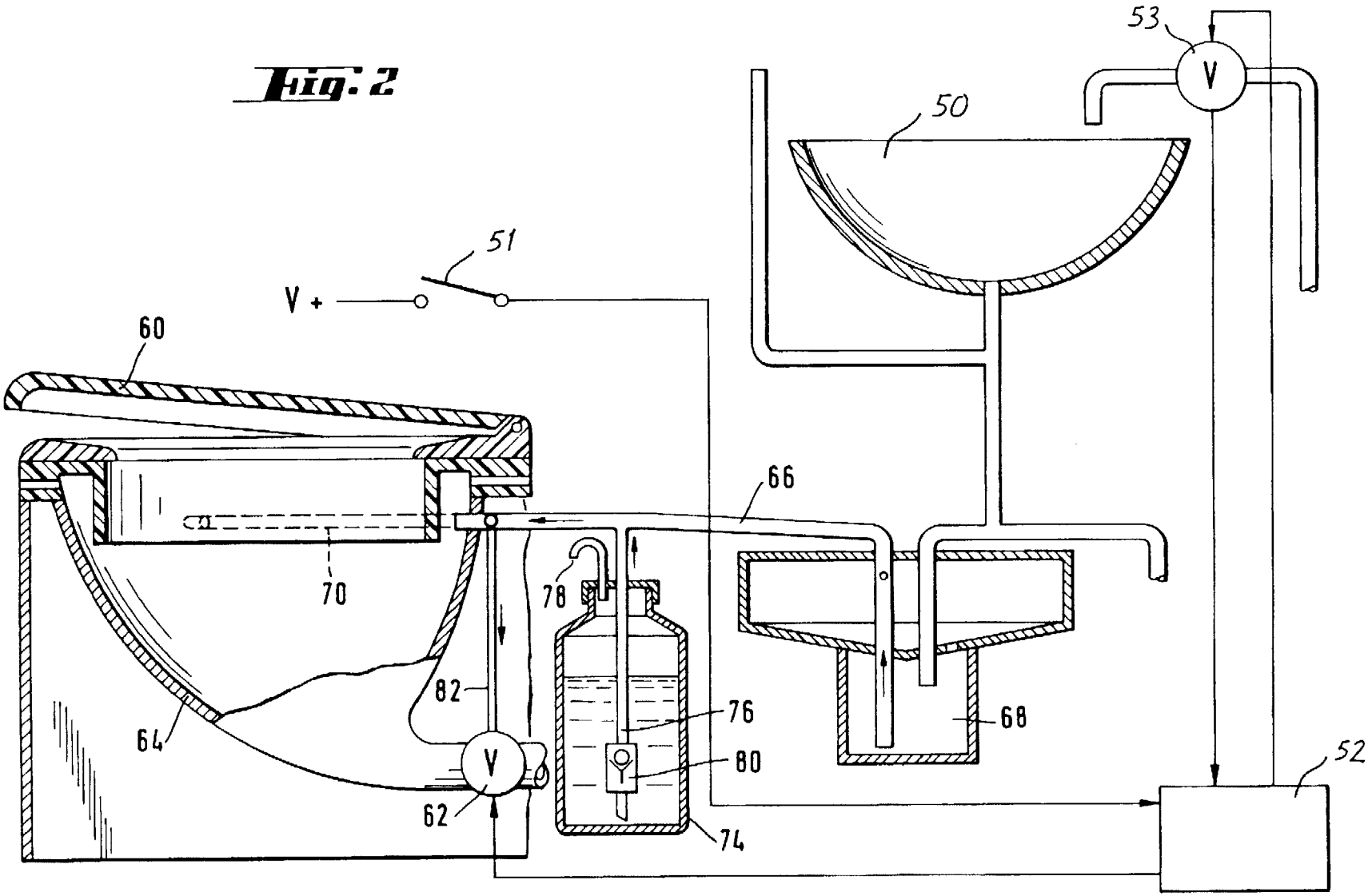
FIG. 2 illustrates schematically a second vacuum toilet system embodying the present invention.

The vacuum toilet system shown in FIG. 2 is similar to that in U.S. Pat. No. 5,245,711, to which reference may be made for a more complete description of the manner of operation of the system shown in FIG. 2. For the purposes of the present invention, it is sufficient to note that when the cover 60 is closed and the discharge valve 62 is open, a partial vacuum is established in the interior space of the bowl 64 and in the rinse water supply pipe 66 and gray water that has previously accumulated in the reservoir 68 is drawn through the rinse water supply pipe 66 to the rinse water distribution pipe 70 and is discharged into the toilet bowl.

The system shown in FIG. 2 includes a container 74 for liquid reagent. A dip tube 76 is connected to the rinse water supply pipe 66 and extends downwards to the bottom of the container, where it is provided with a check valve 80. The container has a vent opening 78 at the top. When a sub-ambient pressure is established in the rinse water supply pipe 66 during a flushing operation, a charge of liquid reagent is drawn from the container and introduced into the flow of water passing through the rinse water supply pipe. As the rinse water and added reagent are introduced into the toilet bowl, air is mixed with the liquid and the action of the surfactant results in formation of an antiseptic foam.

The valve 62 is a rotating disk valve of the kind described in U.S. Pat. No. 4,713,847. A tube 82 is connected between the rinse water supply pipe 66 and the housing of the valve 62 in order to bleed a stream of rinse liquid and added reagent into the valve and inhibit build-up of calcium deposits and plaque in the valve. Injection of rinse liquid into the valve housing reduces the quantity of sewage that can enter the valve housing and dilutes the salt concentration of any sewage that enters the valve housing. Further, the rinse liquid rinses the sewage back into the sewer. In this manner, the build-up of plaque on the valve disk is prevented or at least inhibited. Further, the preferred liquid reagent composition described above has a lubricant effect, thereby reducing drag on the disk, reducing the current needed to rotate the disk, and reducing the time taken for the disk to rotate to an end position. Consequently, the risk of an erroneous response by the FCU is reduced.

It will be appreciated that the invention is not restricted to the particular embodiments that have been described, and that variations may be made therein without departing from the scope of the invention as defined in the appended claims and equivalents thereof. For example, the embodiment shown in FIG. 1 is not restricted to a pump having a displaceable piston, since an ejector pump may be used to draw reagent liquid into the rinse water supply pipe. Further, even when a pump having a displaceable piston is used, the spring may be placed in the large diameter cylinder behind the piston 20, instead of in the pumping chamber. In addition, rinse-water may be introduced into the housing of the discharge valve of the FIG. 1 system, provided that the discharge valve is able to withstand the pressure of the rinse water.

We claim:

1. A method of operating a vacuum toilet system that comprises a toilet bowl having an outlet opening, a sewer pipe having an interior space, a discharge valve connecting the outlet opening of the toilet bowl to the sewer pipe, a source of partial vacuum for establishing a lower pressure in the interior space of the sewer pipe than in the toilet bowl for forcing waste from the toilet bowl into and along the sewer pipe, means defining a rinse liquid outlet for introducing rinse liquid into the toilet bowl during a flush thereof, and a source of rinse liquid, said method comprising, on each flush of the toilet bowl:

(a) delivering rinse liquid from the source to the rinse liquid outlet, (b) adding a reagent to the rinse liquid delivered from the source of rinse liquid, and (c) introducing rinse liquid and reagent into the toilet bowl by way of the rinse liquid outlet, the reagent containing an agent that inhibits formation of deposits of calcium carbonate.

2. A method according to claim 1, wherein the reagent that is added in step (b) includes a surfactant.

3. A method according to claim 2, in which the surfactant is an amphoteric tenside that is present in the liquid reagent at a concentration of about twenty percent by volume.

4. A method according to claim 1, wherein step (b) comprises adding a multi-purpose liquid reagent to the rinse liquid delivered from the source of rinse liquid.

5. A method according to claim 4, wherein the reagent that is added in step (b) contains a surfactant, and an agent that removes existing deposits of calcium carbonate.

6. A method according to claim 1, wherein the reagent that is added in step (b) is a liquid reagent that includes a composition that forms complex ions with calcium.

7. A method according to claim 6, in which said composition is sodium phosphonate and is present in the liquid reagent at a concentration of about 20 percent by volume.

8. A method according to claim 7, wherein the vacuum toilet system includes a rinse liquid supply valve for controlling delivery of rinse liquid from the source of rinse liquid to the rinse liquid outlet, and wherein step (a) comprises intermittently opening the rinse liquid supply valve and step (b) comprises adding liquid reagent to the rinse liquid supplied from the source of rinse liquid.

9. A method according to a claim 1, wherein the vacuum toilet system includes a rinse liquid supply valve for controlling delivery of rinse liquid from the source of rinse liquid to the rinse liquid outlet, and wherein step (a) comprises opening the rinse liquid supply valve and step (b) comprises adding reagent to the rinse liquid supplied from the source of rinse liquid throughout substantially the entire period for which the rinse liquid supply valve is open.

10. A method according to claim 1, wherein step (b) comprises adding a liquid reagent that is acidic to the rinse liquid supplied from the source of rinse liquid.

11. A method according to claim 10, in which the pH of the liquid reagent is about 5.2.

12. A method according to claim 10, in which the liquid reagent contains acetic acid to the extent of about 5 percent by volume.

13. A method according to claim 1, comprising employing a first pump to supply rinse liquid under pressure and a valve connected between the first pump and the rinse liquid outlet for controlling delivery of rinse liquid to the rinse liquid outlet, and employing a second pump to add reagent to rinse liquid between the valve and the rinse liquid outlet.

14. A method according to claim 13, wherein a rinse liquid supply pipe is connected between the valve and the rinse livid outlet and the second pipe is a pressure-actuated pipe, and the method comprises communicating the pressure of rinse liquid in the rinse livid supply pipe to the second pump for actuating the second to add reagent to rinse liquid in the rinse livid supply pipe.

15. A method according to claim 1, wherein step (b) comprises adding a liquid reagent that is acidic and contains a surfactant and a composition that forms complex ions with calcium to the rinse liquid applied from the source of rinse liquid.

16. A method according to claim 15, wherein the pH of the liquid reagent is about 5.2.

17. A method according to claim 16, wherein the surfactant is an amphoteric tenside.

18. A method according to claim 17, wherein said composition is sodium phosphonate and is present in the liquid reagent at a concentration of about 20 percent by volume.

19. A method according to claim 18, in which the liquid reagent is rendered acidic by acetic acid, which is present in the liquid reagent to the extent of about 5 percent by volume.

20. A method according to claim 19, wherein step (b) comprises adding about 1.5 ml of the liquid reagent to the rinse liquid during each flush.

21. A method of operating a vacuum toilet system that is installed in a passenger transport vehicle, such as an aircraft, and comprises a toilet bowl having an outlet opening, a sewer pipe having an interior space, a discharge valve connecting the outlet opening of the toilet bowl to the sewer pipe, a source of partial vacuum for establishing a lower pressure in the interior space of the sewer pipe than in the toilet bowl for forcing waste from the toilet bowl into and along the sewer pipe, means defining a rinse liquid outlet for introducing rinse liquid into the toilet bowl during a flush thereof, and a source of rinse liquid, said method comprising, on each flush of the toilet bowl:

(a) delivering rinse liquid from the source to the rinse liquid outlet, (b) adding a reagent to the rinse liquid delivered from the source of rinse liquid, (c) introducing rinse liquid and reagent into the toilet bowl by way of the rinse liquid outlet, and (d) collecting waste forced from the toilet bowl in a holding tank aboard the vehicle, and wherein step (b) comprises adding an agent that inhibits formation of deposits of calcium carbonate.

22. A method according to claim 21, wherein the reagent that is added in step (b) is a liquid reagent that includes a composition that forms complex ions with calcium.

23. A method according to claim 21, wherein the liquid reagent contains acetic acid.

* * * * *

UNITED STATES PATENT AND TRADEMARK OFFICE
CERTIFICATE OF CORRECTION

PATENT NO. : 5,692,250
DATED : December 2, 1997
INVENTOR(S) : Sven OLDFELT et al It is certified that error appears in the above-identified patent and that said Letters Patent is hereby corrected as shown below:

Column 6, line 58, (Claim 8, line 1), "7" should be deleted and replaced with --1--.

Column 7, line 22, (Claim 14, line 3), "livid" should be deleted and replaced with --liquid-- and "pipe" (both occurrences) should be deleted and replaced with --pump--.

Column 7, line 24, (Claim 14, line 5), "livid" should be deleted and replaced with --liquid--.

Column 7, line 25, (Claim 14, line 6), after "second" should be inserted --pump--.

Column 7, line 26, (Claim 14, line 7), "livid" should be deleted and replaced with --liquid--.

Signed and Sealed this

Twenty-fourth Day of November, 1998

*Attest:*

Bruce Lehman

BRUCE LEHMAN

*Attesting Officer*

*Commissioner of Patents and Trademarks*